US011082777B2

(12) United States Patent
Friis et al.

(10) Patent No.: US 11,082,777 B2
(45) Date of Patent: Aug. 3, 2021

(54) RECEIVER SUSPENSION FOR A HEARING ASSISTING DEVICE

(71) Applicant: WIDEX A/S, Lynge (DK)

(72) Inventors: Lars Friis, Lynge (DK); Christian Christiansen Burger, Lynge (DK); Christian Lyngsoe Svejgaard, Lynge (DK); Jan Topholm, Lynge (DK); Rune Aarup Due, Lynge (DK); Toke Borgen Linander, Lynge (DK); Christian Andersen, Lynge (DK)

(73) Assignee: WIDEX A/S, Lynge (DK)

( * ) Notice: Subject to any disclaimer, the term of this patent is extended or adjusted under 35 U.S.C. 154(b) by 200 days.

(21) Appl. No.: 16/089,759

(22) PCT Filed: Apr. 1, 2016

(86) PCT No.: PCT/EP2016/057226
§ 371 (c)(1),
(2) Date: Sep. 28, 2018

(87) PCT Pub. No.: WO2017/167395
PCT Pub. Date: Oct. 5, 2017

(65) Prior Publication Data

US 2020/0314563 A1 Oct. 1, 2020

(51) Int. Cl.
*H04R 25/00* (2006.01)

(52) U.S. Cl.
CPC ..... *H04R 25/456* (2013.01); *H04R 25/60* (2013.01); *H04R 2225/025* (2013.01); *H04R 2225/57* (2019.05)

(58) Field of Classification Search
CPC ..... H04R 25/456; H04R 2225/021; H04R 2225/025
See application file for complete search history.

(56) References Cited

U.S. PATENT DOCUMENTS

| | | | | |
|---|---|---|---|---|
| 7,088,839 | B2 | 8/2006 | Geschiere et al. | |
| 2006/0291681 | A1 | 12/2006 | Klinkby et al. | |
| 2008/0112584 | A1* | 5/2008 | Karamuk | H04R 25/456 381/324 |
| 2009/0310807 | A1* | 12/2009 | van Halteren | H04R 25/60 381/328 |
| 2012/0269370 | A1 | 10/2012 | Barti et al. | |

FOREIGN PATENT DOCUMENTS

| | | | |
|---|---|---|---|
| DE | 10-2011-007848 | A1 | 10/2012 |
| EP | 2 753 102 | A1 | 7/2014 |

OTHER PUBLICATIONS

Barti, Endre. DE 1020117848 translation (Year: 2012).*
International Search Report for PCT/EP2016/057226 dated Dec. 7, 2016.

* cited by examiner

*Primary Examiner* — Brian Ensey
(74) *Attorney, Agent, or Firm* — Sughrue Mion, PLLC

(57) ABSTRACT

A hearing assisting (10) device including a receiver (1) for generation of acoustic signals and a fixture (3, 8, 9) for positioning the receiver. A suspension (2, 21, 22) supports the receiver to the fixture. The combination of the receiver and the suspension has a mechanical resonance frequency in the range from 6 kHz to 10 kHz.

11 Claims, 5 Drawing Sheets

RECEIVER SUSPENSION FOR A HEARING ASSISTING DEVICE

CROSS REFERENCE TO RELATED APPLICATIONS

This application is a National Stage of International Application No. PCT/EP2016/057226 filed Apr. 1, 2016.

BACKGROUND OF THE INVENTION

The present invention relates to a hearing assisting device. The invention more specifically relates to a hearing assisting device comprising a receiver for generation of acoustic signals and a fixture for positioning the receiver, wherein a suspension supports the receiver within the fixture.

It is well known to arrange a receiver for a hearing assistive device, such as a hearing aid, in a suspension in order to dampen mechanical vibrations from the receiver housing and thereby reducing any feedback to the microphone. Such a solution is e.g. illustrated in U.S. Pat. No. 7,088,839 B2.

When applying special low vibration receivers it is possible to hard-mount the receiver, i.e. mounting it directly to the structure in the hearing aid, e.g. directly to the hearing aid housing, without any suspension, and avoid feedback problems.

A low vibration receiver could be a double receiver or dual diaphragm receiver or back to back receiver, which comprises two receivers in an arrangement balanced to minimise vibrations, arranged in the same receiver housing and having one common sound outlet.

One problem of a hard mounted receiver is that it will be more vulnerable to damage e.g. by mechanical shock. This means that the risk of failure of the receiver when dropping a hearing assisting device on the floor becomes considerably larger when hard mounting the receiver.

SUMMARY OF THE INVENTION

A solution to this problem is a hearing assisting device, where the receiver is arranged in a suspension and the first mechanical resonance frequency of the receiver in the suspension is in the range 6 kHz to 10 kHz.

An advantage of this solution is that it is possible to achieve a high resistance against mechanical shock and a low risk of feedback problems at the same time. There will be other resonance frequencies at higher frequency.

In a preferred embodiment of the hearing assisting device, the combination of the receiver and the suspension has a first resonance frequency in the range 6 kHz to 10 kHz in any main direction. Main directions could be directions extending perpendicular or substantially perpendicular to surfaces of the receiver.

In an embodiment of the hearing assisting device, the receiver is a reduced vibration type receiver. This is defined such that at the frequencies 1 kHz, 3 kHz, 6 kHz and 8 kHz, the receiver has a maximum level of vibration at −20 dB, −10 dB, 0 dB and 10 dB, respectively, when measured in relation to 1 $m/s^2/Pa$ for a freely suspended receiver, e.g. producing a sound pressure in a 711 coupler. Using this type of receiver in a suspension with the resonance frequency in the range of 6 kHz to 10 kHz has been found to provide a solution with almost no risk of feedback problems, and still a very high resistance against mechanical shock.

In an embodiment of the hearing assisting device, the receiver is a double receiver, i.e. a dual diaphragm receiver.

This is a receiver type where the two diaphragms are balanced in order to minimize the mechanical vibrations from the receiver. A few double receivers on the market will exhibit vibration levels lower than the above mentioned maximum values pertaining to a reduced vibration type receiver, and will thus lower the risk of feedback further.

In a further embodiment of the hearing assisting device, the suspension comprises at least four supporting ridges. Hereby it has been found to be relatively simple to manufacture a suspension resulting in a resonance frequency within the range 6 kHz to 10 kHz.

In a further embodiment of the hearing assisting device, the cross sectional shape of the receiver is rectangular or approximately rectangular, and the supporting ridges are arranged on at least two different surfaces of the receiver. A typical receiver has a box-shape with six surfaces; one surface typically reserved for electrical terminals. Another surface, typically the one opposite to the one with terminals, is provided with the sound outlet. In practice, this leaves four surfaces for suspension ridges. Having ridges on at least two surfaces secures a good stability of the receiver's position.

In a further embodiment of the hearing assisting device, ridges are arranged at or towards opposite ends of the receiver, where opposite ends are defined for the longest dimension of the receiver. This makes the position of the receiver more stable and thereby improves reliability.

In a further embodiment of the hearing assisting device, the ridges are arranged on a sleeve arranged around the receiver, the sleeve being made from the same material as the ridges, e.g. integral with the ridges. This has the advantage of being a simple and reliable way to position the ridges at the receiver.

In a further embodiment of the hearing assisting device, the suspension has a mechanical resonance frequency in the range 6.5 kHz to 9.5 kHz or in the range 7.5 kHz to 9.5 kHz. These ranges have been found to be more preferred ranges.

BRIEF DESCRIPTION OF THE DRAWINGS

Embodiments of the invention will now be explained in further detail with reference to the figures.

DETAILED DESCRIPTION OF THE INVENTION

Figure 1:
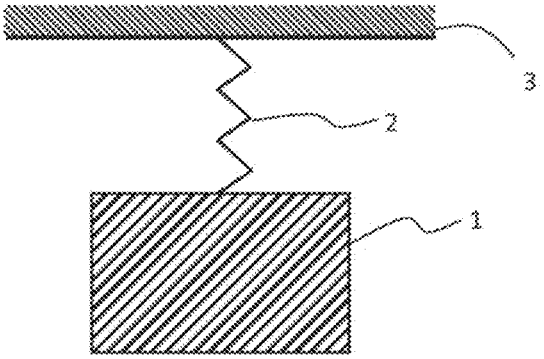
FIG. 1 illustrates the model principle of a receiver connected to a fixture through an elastic suspension.

FIG. 1 shows a model of a suspended receiver 1 connected through a suspension 2 to a fixture 3. The fixture 3 could be the housing of the hearing assisting device or a structure connected to the housing. The suspension 2 is often made from a resilient material such as a rubber or a rubber like material, e.g. a silicone or butyl. The suspension 2 is in practice arranged as a number of ridges or fins extending from the receiver 1 to the fixture 3.

The stiffness S of the suspension can be found by $$S = \frac{EA}{L} \tag{1}$$

where E is the modulus of elasticity for the suspension material, A is the total cross-sectional area for the ridges or fins suspending the receiver. L is the height of the ridges.

Figure 2:
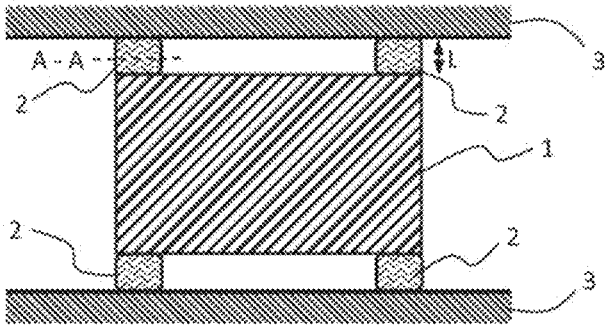
FIG. 2 illustrates a receiver suspended through four supporting members within a fixture.

FIG. 2 shows a practical example of the suspension, where the suspension comprises four ridges 2 squeezed between the fixture 3 and the receiver 1. The ridges hold on to the receiver by a combination of compression and surface friction. On one of the ridges (the upper left) the plane A-A illustrates were the cross-sectional area A is measured. For FIG. 2, the area A would then be the total cross-sectional area for the four ridges. On the upper right ridge it is indicated how the height or length L is measured. Depending on the geometry of the ridges, the area A may be defined as the average cross-sectional area along the height L. This is a preferred measure if the cross sectional area varies along the height L. However, most often the cross sectional area A will be constant or substantially constant along the height L, i.e. when moving from the receiver 1 to the fixture 3.

The first frequency of resonance for such a mass-spring system is found by $$f_0 = \frac{1}{2\pi}\sqrt{\frac{S}{m}} = \frac{1}{2\pi}\sqrt{\frac{EA}{Lm}} \tag{2}$$

where m is the mass of the receiver.

In order to avoid feedback in the hearing assisting device it has been found that $f_0 \geq 6$ kHz. This means that for frequencies up to 6 kHz the vibrations transferred from the receiver to the hearing assisting device as such are equivalent to the vibrations transferred if the receiver were hard mounted. This is an advantage, since hard mounting means that the receiver will have to vibrate a mass, which is a factor 10-15 times larger than the mass of the receiver. Therefore, the level of vibrations transferred (or fedback) to the microphones, will be considerably lower when the receiver is hard mounted or can be considered hard mounted.

For frequencies above the resonance frequency, the receiver suspension cannot be considered hard mounted. Therefore, several other resonances will be present, and the transfer of vibrations to the microphones of the hearing assistive device may become large enough to cause feedback problems.

However, if keeping the resonance frequency at or above 6 kHz (i.e. $f_0 \geq 6$ kHz) is combined with a reduced or low vibration type receiver, such as a dual diaphragm receiver, then the level of vibrations at the microphones will be sufficiently low to avoid feedback problems at the more common levels of amplification applied in a hearing assistive device.

In relation to reliability and durability when exposed to shock, e.g. if the hearing assistive device is dropped on a hard floor, it has been found that a resonance frequency of the receiver in the suspension should be equal to or less than 10 kHz, i.e. $f_0 \leq 10$ kHz.

If the system, i.e. the receiver arrangement in a suspension, has a resonance frequency above 10 kHz, it will be too stiff to absorb mechanical shocks, i.e. the acceleration or deceleration of the receiver will be too large, and the receiver may be damaged. The limit at 10 kHz has been found by testing of receivers commonly used for hearing assisting devices.

By combining the two demands for the resonance frequency in relation to feedback and shock, it follows that the resonance frequency should be in the range 6 kHz to 10 kHz, i.e. 6 kHz$\leq f_0 \leq$10 kHz. In a further embodiment, a resonance frequency limited to the range 6.5 kHz to 9.5 kHz, or limited to the range 7.5 kHz to 9.5 kHz, has been found to work well.

Preferably, these limits on the resonance frequency should apply to vibrations of the receiver in any direction. This can be achieved by placing and shaping the ridges accordingly.

The suspension should be designed according to the actual receiver to be suspended in order to ensure that the resulting first system resonance frequency is in the range 6 kHz to 10 kHz, or in the range 7.5 kHz to 9.5 kHz. As shown above, especially the mass of the receiver is relevant. Typical mass of a receiver for a hearing aid is in the range 0.05-1.0 gram.

An example of a relatively small dual receiver is Sonion 4400 having dimensions 5.00×2.70×1.96 $mm^3$, and a weight of 0.065 gram. An example of a relatively large receiver is Sonion 2000 having the dimensions 9.47×7.18×4.10 $mm^3$, and the weight 0.94 gram. Both receivers are widely used for hearing aids.

Various materials are found to be acceptable for the suspension. An example could be Silicone, 20 Shore A, having an E-module of $4.81 \cdot 10^6$ $N/m^2$. Another example could be Butyl, 50 Shore A, having an E-module of $1.64 \cdot 10^8$ $N/m^2$. Several materials exist having E-modules within the range delimited by these two examples.

When the receiver type and the material for the suspension have been decided, the dimensions of the ridges can be adapted to obtain the desired resonance frequency of the system. The total cross-sectional area A for the ridges will typically be less than or equal to 140 $mm^2$. The height or length L of the ridges is often designed to be in the range 0.2-2.0 mm. Often the parameters will be selected such that the suspension takes up a minimum amount of space, or preferably, such that the receiver with the suspension, when arranged in the hearing assisting device, takes up a minimum amount of space.

Figure 3:
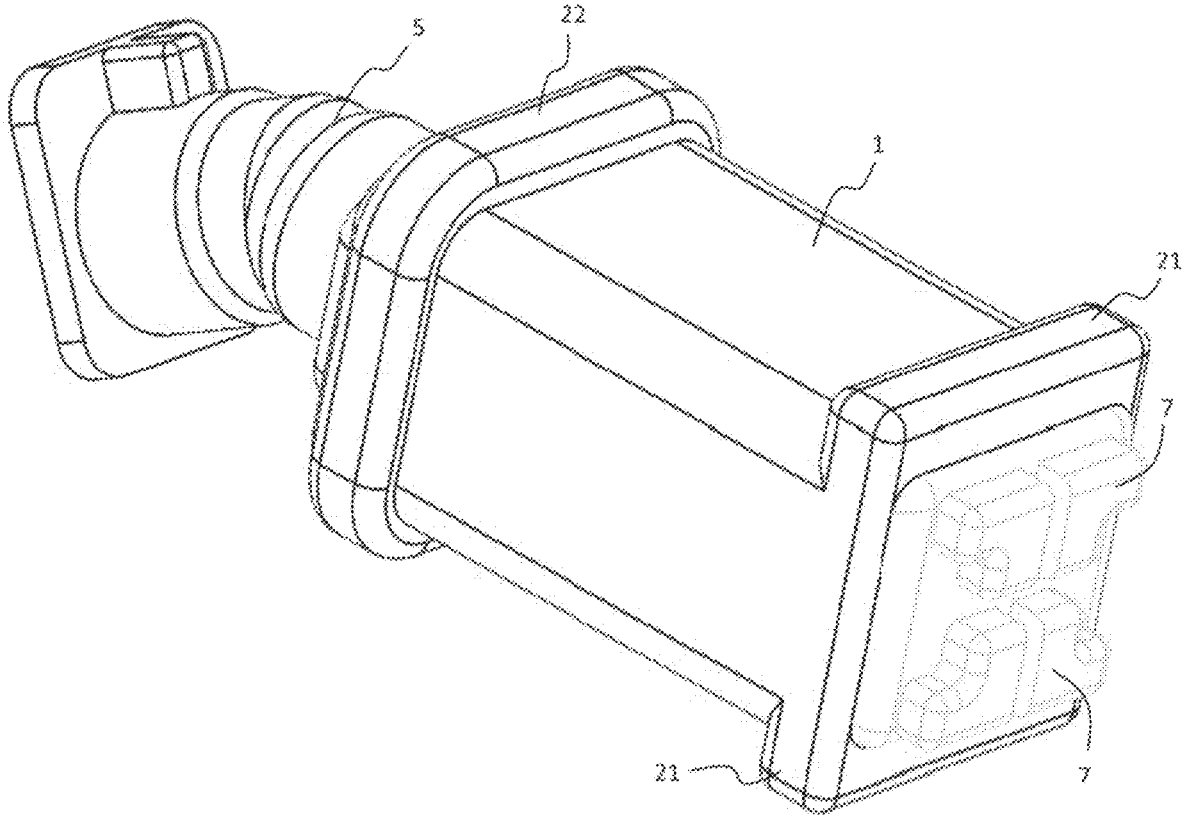
FIG. 3 illustrates a receiver with suspension, where the receiver is connected to a sound outlet.

FIG. 3 shows an example of a receiver 1 arranged with receiver suspension ridges 21, 22. FIG. 3 also illustrates electrical terminals 7 for connecting the receiver 1 to the electronics. Further, a sound outlet tubing 5 is illustrated. It is seen that at one end of the receiver two ridges 21 are situated at opposite sides of the receiver. At the other end of the receiver one ridge 22 is arranged to encircle the receiver, i.e. to extend over the four sides of the receiver.

Many different geometries of the ridges can be applied, the important parameter being the resonance frequency of the suspension. Placing ridges at both ends (in the longest dimension) of the receiver, does however ensure some stability, and may make correct placement during assembling more certain.

It is preferred that the receiver is a reduced vibration type receiver. By "reduced vibration type" is meant that the level of vibrations is significantly lower than for standard receivers. This can e.g. be achieved by a double receiver, i.e. a dual diaphragm receiver. The level of vibration is here measured as the acceleration per output sound pressure in an IEC 711 coupler or ear simulator (IEC referring to an International Electrotechnical Commission standard. The standard may also be referred to as IEC 60 318-4). Such a coupler may be considered as a model ear to be applied as a reference ear and is used for testing of hearing aids and receivers. The 711 coupler is considered to have a volume close to the volume seen from the earplug or the hearing aid in an average person's ear canal. For further description of couplers and ear simulators reference is given to H. Dillon: "Hearing Aids", Boomerang Press, 2001.

The level of vibration is measured with the receivers freely suspended, i.e. no limits on their movements. The level of vibrations is measured as dB relative to 1 $m/s^2/Pa$, and in this context, a reduced vibration type receiver should have the following maximum level of vibrations:

At 1 kHz: −20 dB
At 3 kHz: −10 dB
At 6 kHz: 0 dB
At 8 kHz: 10 dB when measured in the IEC 711 coupler for a freely suspended receiver at the four mentioned frequencies.

Figure 4:
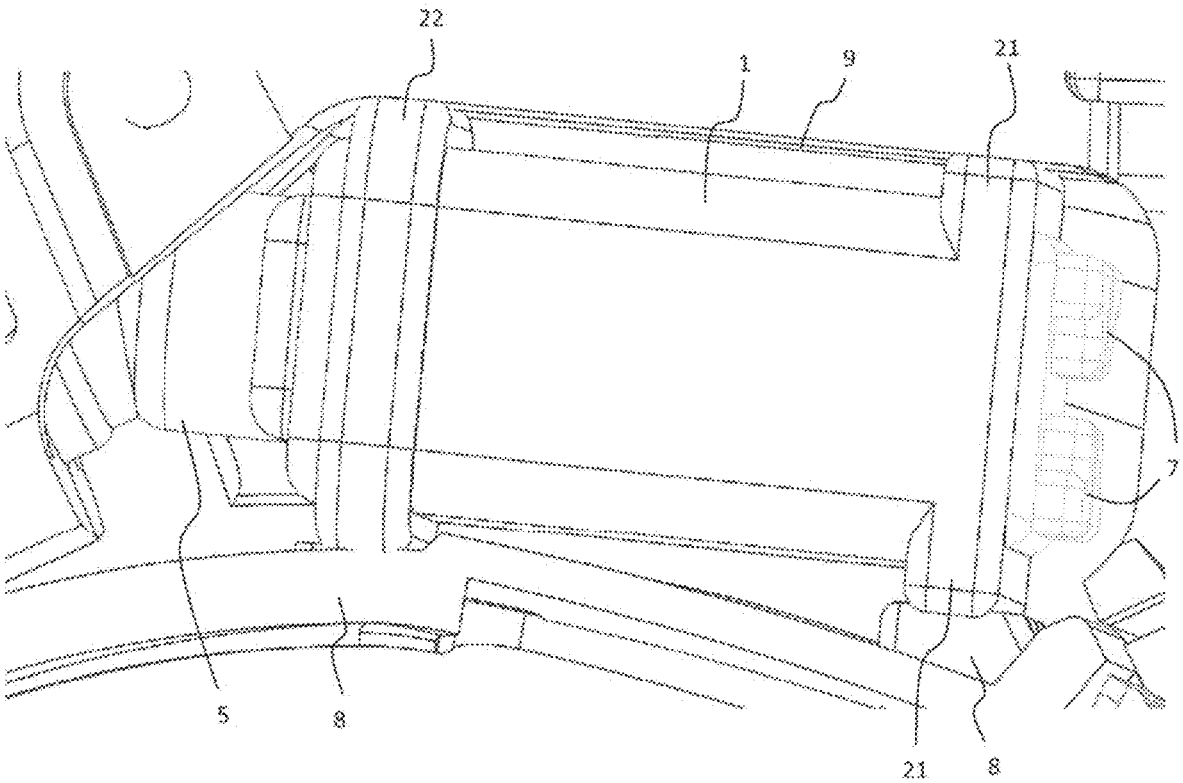
FIG. 4 illustrates a receiver with suspension, fixed in a hearing assisting device.

FIG. 4 shows how the receiver 1 with suspension ridges 21, 22 may be arranged inside a housing of a hearing assistive device. The receiver 1 has been arranged with suspending ridges at each end in an elongated direction, where the electrical terminals 7 are often arranged at one end and a sound outlet, connected to a tubing 5, is often arranged at the opposite end. One ridge 22 is arranged to encircle the receiver, and is here arranged at one end of the elongated receiver. In the other end of the elongated receiver, two ridges 21, each connected to the receiver on one side, are arranged. These two ridges are arranged onto opposing surfaces.

The ridges may be arranged in any pattern whereby the needed resonance frequency can be achieved. However, ridges will often not be arranged on the surface comprising the electrical terminals 7 or on the surface comprising the sound outlet.

The suspension, i.e. the ridges 21, 22, abuts fixtures 8, 9 in the casing or housing of the hearing assistive device. These fixtures 8, 9 may be the housing of the device, or it may be elements, which are connected in a non-moveable manner to the housing.

The different ridges 21, 22 arranged at the receiver may be interconnected by a thin layer of the same material as the ridges is made from, e.g. being integral with the layer. This layer together with the ridges may be formed as a sleeve inside which the receiver can be arranged. The thin layer should preferably have a thickness of less than 0.2 mm, such as less than 0.1 mm. If the material is resilient or elastic, the sleeve can be manufactured to hold the receiver inside in a fixed position.

Figure 5:
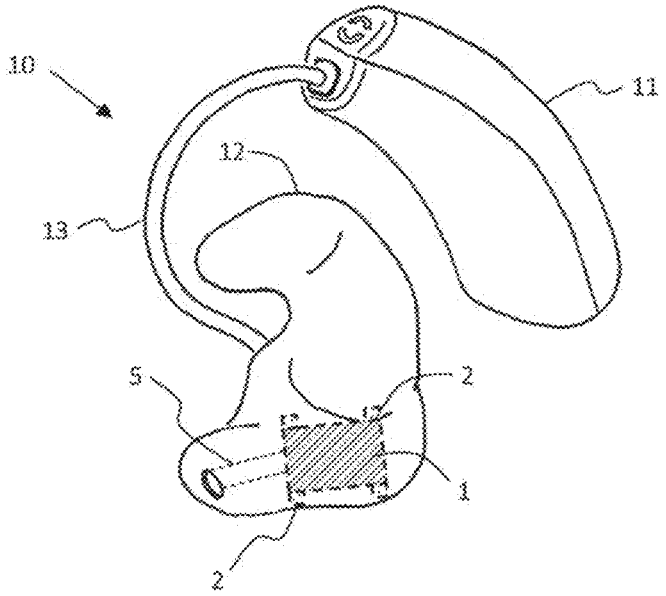
FIG. 5 illustrates a hearing assisting device with the receiver arranged in the earplug part.

FIG. 5 shows an example of a suspended receiver 1 arranged in the earplug part 12 of a Receiver-In-The-Ear (RITE) hearing aid 10. Suspending ridges 2 holding the receiver 1 are illustrated. The receiver is connected to a sound tube 5 inside the earplug part 12. The earplug part 12 is connected to a Behind-The-Ear part 11 through an electrical wire 13.

The hearing assisting device may also be adapted for arrangement completely in the ear canal, or for arrangement partly in the ear canal and partly in the concha part of the ear.

Figure 6:
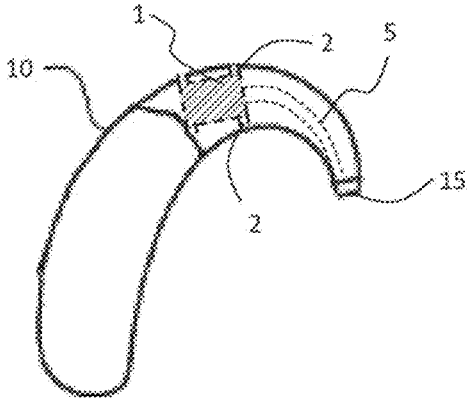
FIG. 6 illustrates a hearing assisting device with the receiver arranged in the behind-the-ear part.

FIG. 6 shows a Behind-The-Ear (BTE) hearing aid 10, where the receiver 1, suspended by ridges 2, is arranged in the BTE part. The receiver is connected to a sound tube 5 guiding the sound to a sound outlet 15 from the BTE part. From this sound outlet 15 the sound is guided by a tubing (not shown) to the ear canal.

Figure 7:
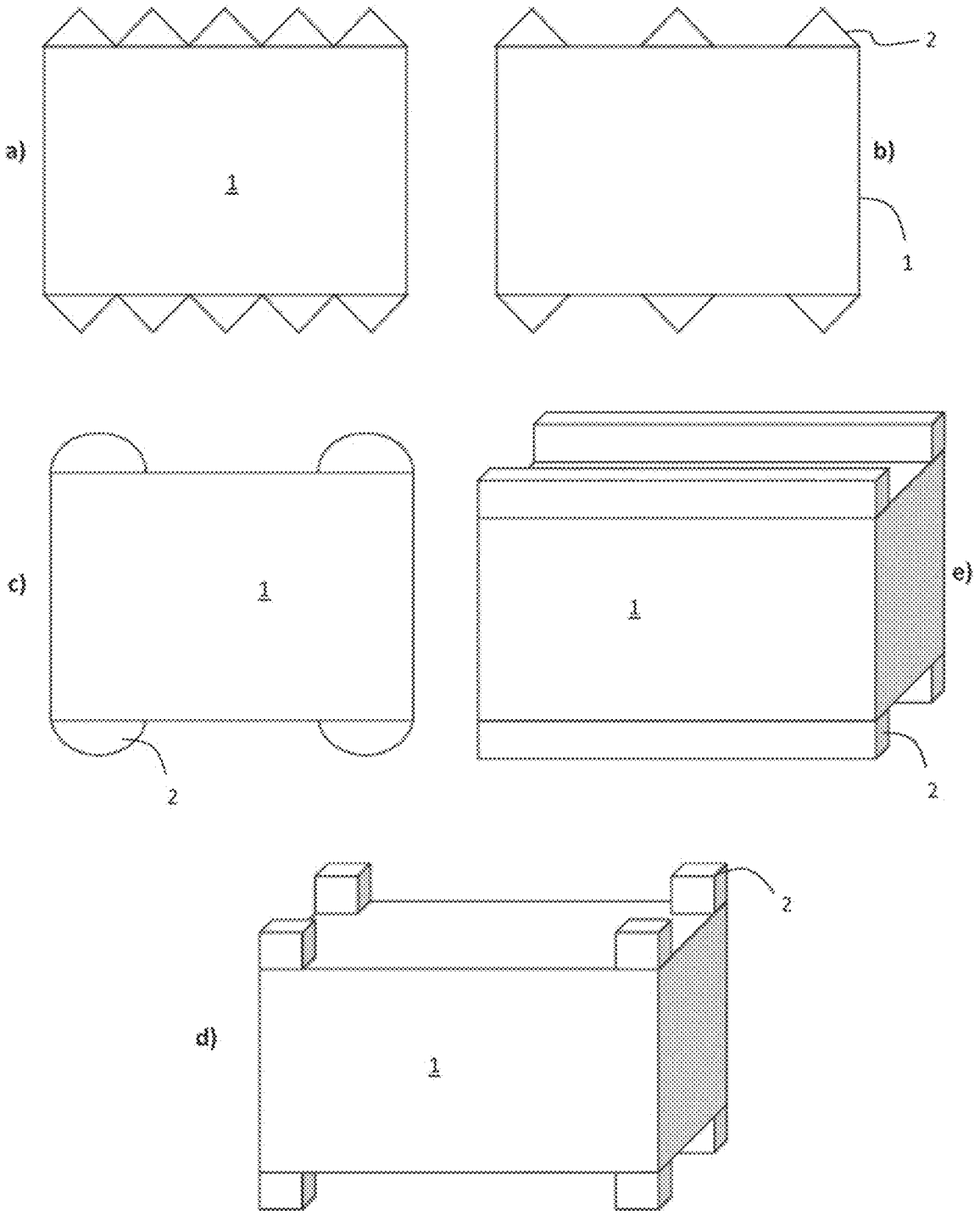
FIG. 7 panes a) to e) illustrate different design options for supporting ridges for the suspension.

FIG. 7 shows different examples of how the supporting ridges may be shaped. In pane a) and b) the supporting ridges have a triangular cross-sectional shape. This shape will provide a softer suspension. The number of triangular supporting ridges can vary, which is the case for any shape of the supporting ridges.

FIG. 7 pane c) shows supporting ridges having a cross-sectional shape of a half circle. Pane e) shows supporting ridges having a square cross-sectional shape. This shape could also be rectangular. A square or rectangular shape provides a high stability of the suspension, and a more rigid supporting ridge compared to the triangular and half circle shape, when the same material is applied.

FIG. 7 pane d) shows that the suspension can comprise cubic shaped supporting elements. These are shown to be arranged towards corners of the receiver, but could also be arranged in other positions. The supporting elements of pane d) are more like feet, i.e. providing support in a point in comparison to the supporting ridges, which supports along a line. These point like supports, or feet, could have other shapes such as pyramid, half spheres or cone shaped.

The suspension can also be a massive layer of a resilient or rubber like material covering a major part, or four surfaces of the receiver. The thickness and the material E-module is then selected to achieve the first resonance frequency in the range from 6 kHz to 10 kHz.

The invention claimed is:

1. A hearing assisting device comprising a receiver for generation of acoustic signals and a fixture for positioning the receiver, where a suspension supports the receiver to the fixture, where the combination of the receiver and the suspension has a first mechanical resonance frequency in the range from 6 kHz to 10 kHz.

2. The hearing assisting device according to claim 1, wherein the receiver is a reduced vibration type receiver, i.e. a receiver exhibiting at the frequencies 1, 3, 6 and 8 kHz a level of vibration at −20, −10, 0 and 10 dB, respectively, when measured in relation to 1 $m/s^2/Pa$ for a freely suspended receiver.

3. The hearing assisting device according to claim 1, wherein the receiver is a double receiver, i.e. a dual diaphragm receiver.

4. The hearing assisting device according to claim 1, wherein the suspension comprises at least four supporting ridges.

5. The hearing assisting device according to claim 1, wherein the cross sectional shape of the receiver is rectangular or approximately rectangular, and wherein the supporting ridges are arranged on at least two different surfaces of the receiver.

6. The hearing assisting device according to claim 5, wherein ridges are arranged at opposite ends of the receiver, where opposite ends are defined for a longest dimension of the receiver.

7. The hearing assisting device according to claim 4, wherein the ridges are arranged on a sleeve arranged around the receiver, the sleeve being made from the same material as the ridges.

8. The hearing assisting device according to claim 1, wherein the receiver arranged in the suspension will have a resonance frequency in the range 6 kHz to 10 kHz in any direction.

9. The hearing assisting device according to claim 1, wherein the suspension is having a mechanical resonance frequency in the range from 6.5 kHz to 9.5 kHz, preferably in the range from 7.5 kHz to 9.5 kHz.

10. The hearing assisting device according to claim 1, wherein the receiver with the suspension is arranged in a behind-the-ear part of the hearing assistive device.

11. The hearing assisting device according to claim 1, wherein the receiver with the suspension is arranged in an ear canal part of the hearing assistive device.

* * * * *